US006774074B2

(12) United States Patent
Rousseau et al.

(10) Patent No.: US 6,774,074 B2
(45) Date of Patent: Aug. 10, 2004

(54) METHOD FOR MAKING BORON NITRIDE FIBERS FROM AMINOBORAZINES

(75) Inventors: Loïc Rousseau, St. Aubin de Medoc (FR); Jean-Christophe Pasquet, Bordeaux (FR); Samuel Bernard, Villeurbanne (FR); Marie-Paule Berthet, Lyons (FR); Jean Bouix, Lyons (FR); David Cornu, Lyons (FR); Philippe Mielé, Lyons (FR); Bérangère Toury, Villeurbanne (FR); Pascaline Toutois, Lyons (FR); Christiane Vincent, Lyons (FR)

(73) Assignee: Eads Launch Vehicles, Paris (FR)

( * ) Notice: Subject to any disclaimer, the term of this patent is extended or adjusted under 35 U.S.C. 154(b) by 0 days.

(21) Appl. No.: 10/220,269

(22) PCT Filed: Mar. 15, 2001

(86) PCT No.: PCT/FR01/00775

§ 371 (c)(1),
(2), (4) Date: Sep. 6, 2002

(87) PCT Pub. No.: WO01/68960

PCT Pub. Date: Sep. 20, 2001

(65) Prior Publication Data

US 2003/0113536 A1 Jun. 19, 2003

(30) Foreign Application Priority Data

Mar. 16, 2000 (FR) ..... 00 03377

(51) Int. Cl.[7] ..... C04B 35/583; C01B 21/064

(52) U.S. Cl. ..... 501/95.1; 501/96.2; 501/96.4; 423/290; 528/7

(58) Field of Search ..... 501/95.1, 96.2, 501/96.4; 423/290; 528/7

(56) References Cited

U.S. PATENT DOCUMENTS

| | | | | | |
|---|---|---|---|---|---|
| 3,668,059 | A | | 6/1972 | Economy et al. | 501/95.1 |
| 4,906,763 | A | * | 3/1990 | Paciorek et al. | 556/403 |
| 4,931,100 | A | * | 6/1990 | Johnson | 524/35 |
| 5,061,469 | A | * | 10/1991 | Kimura | 423/290 |
| 5,470,933 | A | * | 11/1995 | Mignani et al. | 528/24 |
| 5,489,707 | A | * | 2/1996 | Sneddon et al. | 564/10 |
| 5,780,154 | A | * | 7/1998 | Okano et al. | 428/366 |
| 6,277,348 | B1 | * | 8/2001 | Pujol et al. | 423/290 |
| 2003/0180206 | A1 | * | 9/2003 | Miele et al. | 423/290 |
| 2004/0044162 | A1 | * | 3/2004 | Miele et al. | 528/7 |

FOREIGN PATENT DOCUMENTS

| | | |
|---|---|---|
| EP | 0 342 673 | 11/1989 |
| FR | 2 695 645 | 3/1994 |

OTHER PUBLICATIONS

Robert T. Paine et al.: "Synthetic routes to boron nitride" Chem. Rev., vol. 90, pp. 73–91 1990.

Chaitanya K. Narula et al.: "Synthesis of boron nitride ceramics from oligomeric precursors derived from 2–(dimethylamino)–4,6–dichloroborazine" Chem. Mater., vol. 2, pp. 384–389 1990.

Thomas Wideman et al.: "Amine–modified polyborazylenes: second–generation precursors to boron nitride" Chem. Mater., vol. 10, pp. 412–421 1998.

B. Toury et al.: "Thermal oligomerization of unsymmetrically b–trisubstituted borazines" Main Group Metal Chemistry, vol. 22, pp. 231–234 1999.

* cited by examiner

*Primary Examiner*—Karl Group
(74) *Attorney, Agent, or Firm*—Oblon, Spivak, McClelland, Maier & Neustadt, P.C.

(57) ABSTRACT

The invention concerns a method for making boron nitride fibers by drawing a polymer precursor and treating with ceramics the polymer fibers obtained by drawing. The invention is characterized in that the precursor polymer is obtained by thermal polymerization of a borazine of formula (I) wherein: $R^1$, $R^3$, $R^4$ and $R^5$, identical or different, represent an alkyl, cycloalkyl or aryl group; and $R^2$ represents a hydrogen atom or an alkyl, cycloalkyl or aryl group.

8 Claims, No Drawings

METHOD FOR MAKING BORON NITRIDE FIBERS FROM AMINOBORAZINES

TECHNICAL DOMAIN

The purpose of this invention is a process for manufacturing boron nitride fibres, and particularly continuous boron nitride fibres with good mechanical properties that can be used to make ceramic composite materials such as BN/BN composites, thermostructural parts and antenna radomes.

More precisely, it concerns obtaining boron nitride fibres from a polymer precursor that is shaped by spinning to form polymer fibres that are then ceramised to transform them into boron nitride fibres.

STATE OF PRIOR ART

There are many processes for making boron nitride, as described by R. T. PAINE et al in chem. Rev., 90. 1990, pages 73–91 [1]. In particular, the methods described in this document include processes using precursor polymers formed from organic boron compounds such as borazines.

One way of obtaining this type of precursor polymers was described by C. K. Narula et al in Chem. Mater, 2, 1990, pages 384–389 [2]. It consists of making trichloroborazine or 2-(dimethylamino)-4, 6-dichloroborazine react with hexamethyldisilazane in solution in dichloromethane at ambient temperature.

If 2-(dimethylamino)-4,6-dichloroborazine is used, polymerisation at two points is encouraged due to the presence of the $NMe_2$ group. It is noted that the term "polymerisation" is the British spelling for the term "polymerization," and that both these terms mean the same, namely, the process of forming polymer.

Another method of obtaining precursor polymers described in EP-A-0 342 673 [3] consists of making a B-tris (inferior amino alkyl) borazine react with an alkylamine such as laurylamine, either thermally in mass or in solution.

Other precursor polymers can also be obtained by thermal polycondensation of trifunctional aminoborazines with formula $[—B(NR^1R^2)—NR^3—]_3$ in which $R^1$, $R^2$ and $R^3$ are identical or different and represent hydrogen, an alkyl radical or an aryl radical as described in FR-A-2 695 645 [4].

The polymers described above are suitable for obtaining powder or other forms of boron nitride, but it is more difficult to prepare more complex forms, and particularly fibres from this type of polymers.

Frequently, the precursor polymer necessary for shaping the fibres is drawn badly due to its statistical reticulated structure which causes only a slight elongation, making control of the fibre section very random. Later on in the process, this causes breakages of fibres or weak points, which results in very weak final mechanical properties.

As indicated by T. Wideman et al in Chem. Mater., 10, 1998, pp. 412–421 [5], research has been continued to find other precursor polymers that are more suitable for obtaining boron nitride fibres. This document describes that a spinnable precursor polymer in the molten state may be obtained by modifying polyborazylene by reaction with a dialkylamine or with hexamethyldisilazane.

PRESENTATION OF THE INVENTION

The purpose of this invention is a process for manufacturing boron nitride fibres using other precursors to obtain fibres with satisfactory mechanical properties.

According to the invention, this result is achieved using a borazine in which the three boron atoms are substituted by amino groups, at least one of which is different, as the precursor monomer.

According to the invention, the process for manufacturing boron nitride fibres by spinning of a precursor polymer and ceramisation of the polymer fibres obtained by spinning, is characterised in that the precursor polymer is obtained by thermal polymerisation of a borazine of formula (I):

(I)

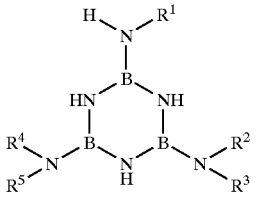

in which $R^1$, $R^3$, $R^4$ and $R^5$ that may be identical or different, represent an alkyl, cycloalkyl or aryl group, and $R^2$ represents a hydrogen atom or an alkyl, cycloalkyl or aryl group.

In this process, the choice of a borazine with formula (I) to form the precursor polymer leads to an approximately linear polymer. The fact that the borazine used is an asymmetric borazine concerning amino groups present on its boron atoms, encourages links between monomer patterns along two lines so that a reticulated polymer is not obtained, inducing a proportion of direct intercyclic links in the polymer.

In the borazine used in the invention, the $R^1$ to $R^5$ groups may represent alkyl, cycloalkyl or aryl groups. Alkyl and cycloalkyl groups may have 1 to 30 carbon atoms, and preferably from 1 to 10 and even better 1 to 4 atoms of carbon. For ceramisation, it is preferable to limit the number of carbon atoms in substitutes to obtain a better conversion rate to boron nitride.

Aryl groups that could be used in the invention may be groups comprising one or several phenyl radicals, and phenyl and benzyl groups are used in preference.

According to one preferred embodiment of the invention, $R^2$ in formula (I) represents a hydrogen atom. The result is then a dysfunctional precursor comprising two NHR amino groups where R is an alkyl, cycloalkyl or aryl group, and a tertiary amino group. This arrangement is favourable for obtaining a polymer with better spinning performances.

Also preferably, the remaining $R^1$, $R^3$, $R^4$, $R^5$ groups are methyl groups since they facilitate good ceramic efficiency.

Also according to a first embodiment of the invention, borazine complies with formula (I) in which $R^2$ represents a hydrogen atom and $R^1$, $R^3$, $R^4$, and $R^5$ represent the methyl group. Therefore, this is [2,4-bis(monomethylamino)-6-dimethylamino]borazine.

According to a second embodiment of the invention, borazine complies with formula (I) where $R^1$ to $R^5$ represent the methyl group corresponding to [2,4-bis(dimethylamino)-6-monomethylamino]borazine.

These borazines may be synthesised by the process described by B. Toury et al in Main Group Met. Chem. 22, 1999, pp. 231–234 [6]. In this document, it was shown that polymerisation of borazines of the same type at moderate temperatures (140 to 145° C.) leads to polymers with direct B—N links between two borazine radicals. On the other hand, linearity of the polymer was not observed.

This work should have encouraged an expert in the subject to decide not to use this type of borazine to obtain precursor polymers with a better behaviour in spinning, since the presence of direct links should have been negative for spinning since the polymer was less flexible.

On the contrary, it is observed with this invention that this type of structure is very attractive since it is actually very close to the structure of the ceramic. Furthermore, this arrangement limits aggregation of cycles during polymerisation, which finally results in a non-rigid and easier to spin pseudo-linear polymer. Furthermore, it is easy to move the amino-labile groups remaining on the polymer chain during ceramisation.

According to the invention, thermal polymerisation of borazine with formula (I) is carried out preferably at a final temperature exceeding 140° C., for example from 160 to 190° C. It is possible to operate under argon in an autogenous atmosphere, in other words to retain an atmosphere of amines that are compounds released during thermolysis, above the polymer. Polymerisation can also be done under an inert gas flow (rare gas or nitrogen) or under a vacuum, by adapting temperatures and durations. Usually, since the initial borazines put into the reactor may contain a certain quantity (up to 20% by weight) of a synthesis solvent such as toluene, it is preferable firstly to dry the monomer under a primary vacuum before carrying out the polymerisation step. This drying may be done at a temperature from 30 to 80° C., to eliminate the synthesis solvent.

During the polymerisation step, the eliminated volatile products can be analysed continuously, either by pHmetry or by gaseous chromatography to control the polymerisation operation. These volatile products can also be trapped at low temperature and then analysed by the usual spectroscopic techniques.

Heating programs and durations and the atmospheres used depend on the borazine used in formula (I).

After the polymerisation step, a polymer is obtained with a vitreous transition temperature of less than 100° C., so that spinning is possible at temperatures less than 200° C.

The polymer can be spun using conventional techniques, using nozzles including one hole only or several holes. The fibre leaving the nozzle may be wound onto graphite reels. Preferably, spinning is done in an inert atmosphere, for example under a nitrogen atmosphere. The polymer fibres are ceramised after spinning. When the reels are not treated immediately, they can be kept in an inert chamber or under a vacuum.

For ceramisation of the fibres, the temperatures, heating rates, durations and the atmosphere used are chosen as the function of the precursor polymer used and the result to be obtained.

Preferably, ceramisation is done in two steps.

The first preceramisation step consists of heating the fibres, for example up to a temperature of less than or equal to 1000° C., and preferably from 400 to 600° C. in an $NH_3$ atmosphere.

The second ceramisation step itself is carried out by increasing the temperature of the preceramised fibres to a higher level of at least 1400° C., for example from 1400° C. to 2200° C.

This step is done under a nitrogen and/or a rare gas atmosphere in one or several operations, and possibly with intermediate cooling at ambient temperature.

For example, this step may be carried out under a nitrogen atmosphere at a temperature from 1600 to 1800° C. and under a rare gas atmosphere beyond this temperature.

Another purpose of this invention is continuous boron nitride fibres obtained using the process described above, characterised in that they have an average breaking stress ($\sigma_R$) of 1000 to 2000 MPa and the Young's Modulus E is between 80 and 250 GPa.

Other characteristics and advantages of the invention will be better seen after reading the following examples, obviously given for illustrative purposes and in no way restrictive.

DETAILED PRESENTATION OF EMBODIMENTS

The following examples illustrate the production of boron nitride fibres starting from [2,4-bis(monomethylamino)-6-dimethylamino]borazine and [2,4-bis(dimethylamino)-6-monothylamino]borazine.

EXAMPLE 1

Synthesis of [2,4-bis(monomethylamino)-6-dimethylamino]borazine

This borazine is obtained starting from trichloroborazine (TCB) by the addition of a dimethylamine equivalent for a TCB equivalent and then, after reaction, the addition of two monomethylamine equivalents, corresponding to the following reactional diagram:

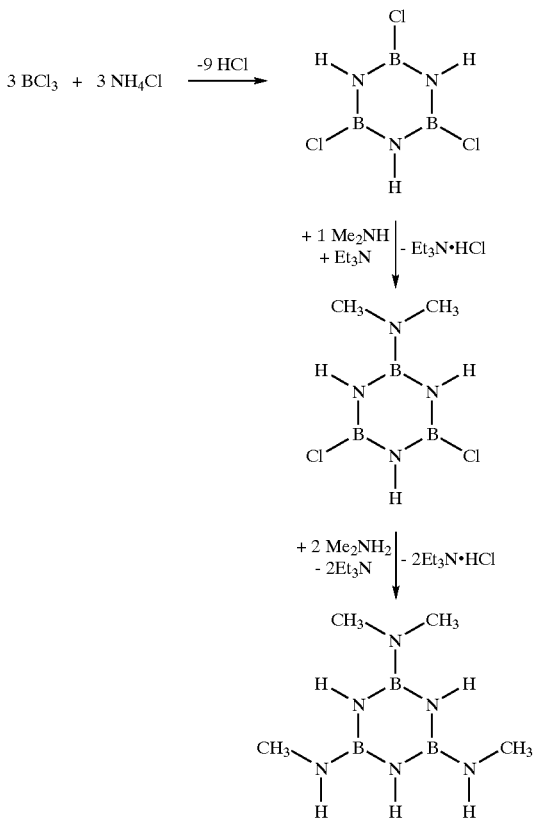

Synthesis is done in toluene. The dimethylamine is cryopumped in a TCB/toluene/$Et_3N$ solution (0.30 M in TCB) and the reaction mix is then adjusted to the temperature of an acetone/ice bath at −10° C. for 5 hours, and stirring is then continued for another 19 hours. The same procedure is then continued with monomethylamine using two monomethylamine equivalents for one TCB equivalent. The next step is to filter the reaction mix, and the solvent is then evaporated under a vacuum. The result is then a light orange viscous product containing about 5% of toluene by mass. The product is characterised by multi-radicals, infrared NMR and chromatography by gel permeation.

Low intensity signals are still observed in $^{1}H$ and $^{13}C$ NMR, that can be assigned to the dimer with the following formula:

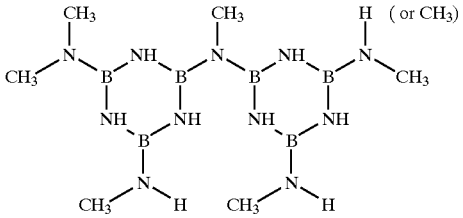

EXAMPLES 2 to 5

Polymerisation of [2,4-bis(monomethylamino)-6-dimethylamino]borazine

In these examples, the first step is to vacuum dry the monomer at a temperature of 50 to 80° C., and polymerisation is then carried out under an argon atmosphere using different temperature programs.

The temperatures and durations used for polymerisations are given in table 1. The next step is to determine the resulting polymer mass, the polymerisation rate, in other words the number of moles of nitrogen atoms released in the form of aminos per aminoborazine mole, the average molar mass of polymer and its vitreous transition temperature Tg.

Polymerisation conditions and the results obtained are given in table 1.

Thus, it will be noted that the vitreous transition temperatures of polymers are not more than 90° C. and their average molar masses are of the order of 780 to 1000 g/mol.

EXAMPLES 6 to 17

In these examples, spinning, and then ceramisation of the polymers obtained in examples 2 to 5 are carried out. For spinning, a piston with a diameter of 9.98 mm moving at a speed within the range from 0.8 to 1.3 mm/min, and a nozzle with a diameter of 200 $\mu$m, are used. The spinning temperature varies from 137 to 192° C. At the exit from the nozzle, the fibres are wound onto a graphite reel with a diameter of 50 mm in examples 6 to 14, and onto a graphite reel with a diameter of 100 mm in examples 15, 16 and 17. The spooling speed can vary from 1.5 revolutions/second to 25 revolutions/second.

Spinning conditions and the initial polymers are given in tables 2 to 4. After spinning, the polymer fibres are ceramised under the conditions described below.

Ceramisation A:

a) Preceramisation: heat up to 600° C. at a rate of 25° C./h, under $NH_3$.

b) Ceramisation:

Heat from 600 to 1100° C., at a rate of 100° C./h under $N_2$.

Hold at 1100° C., under $N_2$ for 90 minutes.

Cool to ambient temperature.

Heat up to 1400° C., at a rate of 600° C./h, under $N_2$.

Hold at 1400° C., under $N_2$, for 1 hour.

Heat from 1400° C. to 1600° C., at a rate of 600° C./h, under $N_2$.

Hold at 1600° C., under $N_2$ for 1 hour.

Heat from 1600 to 1800° C., at a rate of 600° C./h under $N_2$.

Hold at 1800° C., under $N_2$ for 1 hour.

Ceramisation B:

a) Preceramisation: heat up to 600° C. at a rate of 25° C./h, under $NH_3$.

b) Ceramisation:

Heat from 600 to 1100° C., at a rate of 100° C./h under $N_2$.

Hold at 1100° C., under $N_2$ for 90 minutes.

Cool to ambient temperature.

Heat up to 1400° C., at a rate of 600° C./h, under $N_2$.

Hold at 1400° C., under $N_2$, for 1 hour.

Heat from 1400° C. to 1600° C., at a rate of 600° C./h, under $N_2$.

Hold at 1600° C., under $N_2$ for 1 hour.

Ceramisation C:

a) Preceramisation

Heat up to 375° C. at a rate of 10° C./h, under $NH_3$.

Heat from 375° C. to 600° C. at a rate of 15° C./h, under $NH_3$.

b) Ceramisation:

Heat from 600 to 1100° C., at a rate of 100° C./h under $N_2$.

Hold at 1100° C., under $N_2$ for 90 minutes.

Cool to ambient temperature.

Heat up to 1400° C., at a rate of 600° C./h, under $N_2$.

Hold at 1400° C., under $N_2$, for 1 hour.

Heat from 1400° C. to 1600° C., at a rate of 600° C./h, under $N_2$.

Hold at 1600° C., under $N_2$ for 1 hour.

Ceramisation D:

a) Preceramisation: heat up to 600° C. at a rate of 25° C./h, under $NH_3$.

b) Ceramisation:

Heat from 600 to 1100° C., at a rate of 100° C./h under $N_2$.

Hold at 1100° C., under $N_2$ for 90 minutes.

Cool to ambient temperature.

Heat up to 1400° C., at a rate of 600° C./h, under $N_2$.

Hold at 1400° C., under $N_2$, for 1 hour.

Heat from 1400° C. to 1600° C., at a rate of 600° C./h, under $N_2$.

Hold at 1600° C., under $N_2$ for 1 hour.

Heat from 1600 to 1800° C., at a rate of 600° C./h under $N_2$.

Hold at 1800° C., under $N_2$ for 1 hour.

Heat from 1800 to 2000° C., at a rate of 600° C./h under argon.

Hold at 2000° C., under argon, for 1 hour.

After obtaining ceramised fibres, the diameter of the fibres, their ultimate stress $\sigma_R$ (in MPa) and their Young's modulus E (in GPa) are determined as follows.

The ultimate stress $\sigma_R$ is determined on about fifty single filaments with a test piece length of 1 cm. The ultimate tests are analysed using Weibull's model in which the ultimate stresses are determined for a failure of probability equal to 0.5. An average value of the distribution of the elongations to rupture ($\epsilon_R$) is defined, and this value is used to calculate the median value of the distribution of ultimate stresses ($\sigma_R$) at a survival probability of 0.5. The Young's Modulus or the Modulus of Elasticity E can then be determined.

Spinning and ceramisation conditions and the results obtained are given in tables 2 to 4.

Note that the values of the modulus E of the boron nitride fibres obtained are very high and vary from 150 to 244 GPa, and the ultimate stresses $\sigma_R$ are also very high.

Thus, the use of the polymer obtained from [2,4-bis (monomethylamino)-6-dimethylamino]-borazine) according to the invention can give very attractive results and produce boron nitride fibres with high performances.

EXAMPLE 18

Preparation of boron nitride Fibres from [2,4-bis (dimethylamino)-6-monomethylamino] borazine a) Synthesis of the Monomer The monomer is obtained in the same way as the monomer in example 1, but by adding two dimethylamine equivalents for one equivalent of TCB, and then after the reaction, a single equivalent of monomethylamine. The monomer is characterised by multi-radicals, infrared and chromatography NMR by gel permeation.

b) Polymerisation

Thermal polymerisation of the monomer is done under the following conditions:

50° C.—1 h00 (under argon),

80° C.—1 h00 (under argon),

130° C.—1 h30 (under argon),

160° C.—13 h00 (under argon),

175° C.—4 h00 (under argon),

180° C.—4 h00 (under argon), and

185° C.—2 h00 (under argon).

The resulting progress is 22%. The vitreous transition temperature of the polymer is of the order of 50° C.

The average molecular mass by weight is 500 g/mol.

c) spinning and ceramisation

The polymer is spun as in examples 1 to 17, under the following conditions:

$T_{spinning}$ . . . : 119° C.

Piston speed . . . : 0.8 to 1 mm/min

Spooling speed . . . : 1.5 rps

The diameter of the raw fibres is 21 $\mu$m.

The next step is ceramisation of the fibres using ceramisation A. The result is 14.8 $\mu$m diameter ceramised fibres with the following mechanical characteristics.

$\sigma_R$: 512 MPa

E: 57 GPa

References

[1]: R. T. PAINE et al, Chem. Rev., 90, 1990, pp. 73–91.
[2]: C. K. Narula et al in Chem Mater, 2, 1990, pp. 384–389.
[3]: EP-A-0 342 673.
[4]: FR-A-2 695 645.
[5]: T. Wideman et al, Chem. Mater., 10, 1998, pp. 412–421.
[6]: B. Toury et al in Main Group Met. Chem. 22, 1999, pp. 231–234.

TABLE 1

| EX | 2 | 3 | 4 | 5 |
|---|---|---|---|---|
| Polymerisation | 130° C. - 1h00 (arg)<br>160° C. - 16h00 (arg)<br>170° C. - 1h30 (arg) | 80° C. - 30 min (arg)<br>130° C. - 1h00 (arg)<br>160° C. - 17h00 (arg)<br>170° C. - 2h20 (arg) | 80° C. - 1h (arg)<br>140° C. - 1h00 (arg)<br>170° C. - 14h30 (arg)<br>180° C. - 40 min (arg) | 80° C. - 30 min (arg)<br>130° C. - 1h20 (arg)<br>160° C. - 16h00 (arg)<br>170° C. - 2h30 (arg)<br>175° C. - 1h30 (arg) |
| Monomer mass | $m_m$ = 7.6 g | $m_m$ = 11.0 g | $m_m$ = 11.5 g | $m_m$ = 10.7 g |
| Polymer mass | $m_p$ = 6.4 g | $m_p$ = 9.1 g | $m_p$ = 9.3 g | $m_p$ = 8.6 g |
| Polymerisation rate | 0.72 | 0.78 | 1.17 | 0.90 |
| Average molar mass | MW = 780 g/mol | MW = 840 g/mol | MW = 1000 g/mol | MW = 1000 g/mol |
| $T_g$ | $T_g$ = 56° C. | $T_g$ = 60° C. | $T_g$ = 90° C. | $T_g$ = 65° C. |

TABLE 2

| EX | 6 | 7 | 8 | 9 |
|---|---|---|---|---|
| Polymer | Example 2 | Example 3 | Example 3 | Example 4 |
| Spool diameter | 50 mm | 50 mm | 50 mm | 50 mm |
| $T_{spinning}$ | 137° C. | 152° C. | 153° C. | 192° C. |
| $S_{spooling}$ | 1.5 rev/sec | 8 rev/sec | 12 rev/sec | 5.2 rev/sec |
| $S_{piston}$ | 1.2 mm/min | 0.9–1 mm/min | 0.8 mm/min | 0.9–1 mm/min |
| Ceramisation | A | A | A | A |
| ϕ ceramised fibres ($\mu$m) | 10.7 | 11.6 | 11.4 | 24.1 |
| σ (MPa) | 685 | 851 | 1241 | 423 MPa |
| E (GPa) | 170 | 149 | 218 | 77 GPa |

TABLE 3

| EX | 10 | 11 | 12 | 13 | 14 |
|---|---|---|---|---|---|
| Polymer | Example 5 | Example 5 | Example 5 | Example 5 | Example 5 |
| Spool diameter | 50 mm | 50 mm | 50 mm | 50 mm | 50 mm |
| $T_{spinning}$ | 163° C. | 164° C. | 164° C. | 164° C. | 164° C. |
| $S_{spooling}$ | 25 rev/sec | 17 rev/sec | 25 rev/sec | 17 rev/sec | 25 rev/sec |
| $S_{piston}$ | 1–1.3 mm/min | 1 mm/min | 1 mm/min | 0.9 mm/min | 0.9 mm/min |
| Ceramisation | A | B | B | C | C |
| ϕ ceramised fibres (μm) | 11.2 | 11.2 | 10.7 | 11.5 | 9.9 |
| σ (MPa) | 1177 | 1287 | 1367 | 900 | 1157 |
| E (GPa) | 193 | 175 | 209 | 192 | 214 |

TABLE 4

| EX | 15 | 16 | 17 |
|---|---|---|---|
| Polymer | Example 5 | Example 5 | Example 5 |
| Spool diameter | 100 mm | 100 mm | 100 mm |
| $T_{spinning}$ | 164° C. | 164° C. | 164° C. |
| $S_{piston}$ | 0.9 mm/min | 0.9 mm/min | 0.9 mm/min |
| $S_{spooling}$ | 20 rev/sec | 10 rev/sec | 7 rev/sec |
| Ceramisation | D | D | A |
| ϕ ceramised fibres (μm) | 6.4 | 6.7 | 8.0 |
| σ (MPa) | 1189 | 1242 | 819 |
| E (GPa) | 166 | 244 | 186 |

What is claimed is:

1. A process for manufacturing boron nitride fibres comprising:

spinning a precursor polymer to obtain polymer fibres, and subjecting the polymer fibres to ceramisation.

wherein the precursor polymer is obtained by thermal polymerization of a borazine of formula (I):

(I)

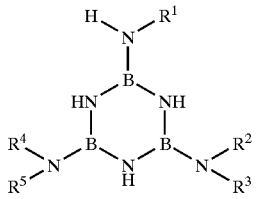

in which $R^1$, $R^3$, $R^4$ and $R^5$ which may be identical or different, represent an alkyl, cycloalkyl or aryl group, and $R^2$ represents a hydrogen atom or an alkyl, cycloalkyl or aryl group.

2. The process according to claim 1, wherein $R^2$ represents a hydrogen atom.

3. The process according to claim 2, wherein the borazine complies with formula (I) in which $R^1$, $R^3$, $R^4$ and $R^5$ represent a methyl group.

4. The process according to claim 1, wherein the borazine complies with formula (I) in which $R^1$, $R^2$, $R^3$, $R^4$ and $R^5$ represent a methyl group.

5. The process according to claim 1, wherein the thermal polymerization is done at a final temperature of 160 to 190° C. under an inert atmosphere.

6. The process according to claim 1, wherein the precursor polymer is spun under an inert atmosphere at a temperature of less than 200° C.

7. The process according to claim 1, wherein the polymer fibres are transformed into boron nitride fibres by carrying out the following steps in sequence:

a) heating in an $NH^3$ atmosphere up to a temperature of less than or equal to 110° C., and b) heat treating in a nitrogen atmosphere, a rare gas atmosphere or combinations thereof, at a temperature of at least 1400° C.

8. The process according to claim 7, wherein the heat treatment in step b) is carried out under a nitrogen atmosphere at a temperature of 1600 to 1800° C. and under a rare gas atmosphere beyond this temperature.

* * * * *